US005697988A

United States Patent [19]

Malfer et al.

[11] Patent Number: 5,697,988

[45] Date of Patent: *Dec. 16, 1997

[54] FUEL COMPOSITIONS

[75] Inventors: Dennis J. Malfer, Crestwood; Lawrence J. Cunningham, Kirkwood, both of Mo.

[73] Assignee: Ethyl Corporation, Richmond, Va.

[ * ] Notice: The term of this patent shall not extend beyond the expiration date of Pat. No. 5,514,190.

[21] Appl. No.: 665,052

[22] Filed: Jun. 7, 1996

Related U.S. Application Data

[63] Continuation of Ser. No. 551,359, Nov. 1, 1995, abandoned, which is a continuation of Ser. No. 133,442, Oct. 6, 1993, abandoned, which is a continuation-in-part of Ser. No. 793,544, Nov. 18, 1991, abandoned.

[51] Int. Cl.[6] ..... C10L 1/22

[52] U.S. Cl. ..... 44/415; 44/443

[58] Field of Search ..... 44/415, 443, 447, 44/450, 417, 418, 419, 432, 433

[56] References Cited

U.S. PATENT DOCUMENTS

| | | | |
|---|---|---|---|
| 2,563,101 | 8/1951 | Colwell et al. . | |
| 2,807,525 | 9/1957 | Foreman | 44/443 |
| 2,962,442 | 11/1960 | Andress, Jr. et al. . | |
| 3,443,918 | 5/1969 | Kautsky et al. . | |
| 3,502,451 | 3/1970 | Moore et al. . | |
| 3,539,633 | 11/1970 | Piasek et al. . | |
| 3,649,659 | 3/1972 | Otto et al. . | |
| 3,658,494 | 4/1972 | Dorer, Jr. . | |
| 3,658,495 | 4/1972 | Dorer, Jr. . | |
| 3,717,446 | 2/1973 | Howland et al. . | |
| 3,756,793 | 9/1973 | Robinson . | |
| 3,948,619 | 4/1976 | Worrel . | |
| 3,980,569 | 9/1976 | Pindar et al. . | |
| 3,994,698 | 11/1976 | Worrel . | |
| 4,025,316 | 5/1977 | Stover . | |
| 4,038,043 | 7/1977 | Garth . | |
| 4,038,044 | 7/1977 | Garth . | |
| 4,039,300 | 8/1977 | Chloupek et al. . | |
| 4,054,422 | 10/1977 | Garth . | |
| 4,083,699 | 4/1978 | Chibnik . | |
| 4,088,586 | 5/1978 | Wilgus et al. . | |
| 4,116,644 | 9/1978 | Jackisch et al. . | |
| 4,117,011 | 9/1978 | Malec . | |
| 4,166,726 | 9/1979 | Harle . | |
| 4,198,306 | 4/1980 | Lewis . | |
| 4,231,759 | 11/1980 | Udelhofen et al. | 44/415 |
| 4,242,212 | 12/1980 | Hanson . | |
| 4,396,517 | 8/1983 | Gemmill, Jr. et al. . | |
| 4,464,182 | 8/1984 | Tack et al. . | |
| 4,548,616 | 10/1985 | Sung et al. . | |
| 4,661,120 | 4/1987 | Carr et al. . | |
| 4,846,848 | 7/1989 | Miles et al. . | |
| 4,859,210 | 8/1989 | Franz et al. . | |
| 4,877,416 | 10/1989 | Campbell . | |
| 5,004,478 | 4/1991 | Vogel et al. | 44/398 |
| 5,006,130 | 4/1991 | Aiello et al. | 44/432 |
| 5,061,291 | 10/1991 | Sung | 44/347 |
| 5,089,028 | 2/1992 | Abramo et al. | 44/347 |
| 5,242,469 | 9/1993 | Sakakibara et al. | 44/347 |
| 5,503,644 | 4/1996 | Graiff et al. | 44/415 |
| 5,514,190 | 5/1996 | Cunningham et al. | 44/415 |

FOREIGN PATENT DOCUMENTS

| | | |
|---|---|---|
| 2089833 | 8/1993 | Canada . |
| 0235868 | 9/1987 | European Pat. Off. . |
| 0376578 | 7/1990 | European Pat. Off. . |
| 2064681 | 1/1973 | Germany . |
| 1486144 | 9/1977 | United Kingdom . |

*Primary Examiner*—Alan Diamond
*Attorney, Agent, or Firm*—Dennis H. Rainear; Thomas Hamilton

[57] ABSTRACT

This invention relates to a novel fuel additive composition which provides reduced engine deposits and control of octane requirement increase in engines. The composition comprises:

a) a Mannich reaction product of (i) a high molecular weight alkyl-substituted phenol, (ii) amine, and (iii) aldehyde wherein the ratio of (i) to (ii) to (iii) in the reaction is within the range of from 1.0:0.1–10:0.1–10;

b) a polyoxyalkylene compound; and c) optionally, poly-α-olefin;

wherein the additive composition contains from about 50 to about 90 wt. % of (a), from about 10 to about 50 wt. % of (b), and from about 0 to about 40 wt. % of (c).

33 Claims, No Drawings

FUEL COMPOSITIONS

BACKGROUND

This application is a continuation of application Ser. No. 08/551,359, filed Nov. 1, 1995, now abandoned, which in turn is a continuation of prior application Ser. No. 08/133,442, filed Oct. 6, 1993, now abandoned, which is a continuation-in-part of application Ser. No. 07/793,544, filed Nov. 18, 1991 now abandoned.

This invention relates in general to fuel additives compositions used for control of engine deposits without affecting octane requirement increase in the engine.

As is well known, fuels used in internal combustion engines contain a number of additives to enhance the performance of the engines. However, these additives oftentimes lead to the buildup of undesirable engine deposits. It is believed that some engine deposits may affect the octane requirement increase of internal combustion engines. An object of this invention is to provide compositions capable of reducing the buildup of deposits in engines as well as reducing deposits which are already present due to prior operation of the engines with fuels which have formed such deposits.

As the emphasis has shifted to providing fuels and fuel mixtures which are more environmentally "friendly", and as more vehicles are being equipped with fuel injectors to increase the efficiency and further reduce emissions from gasoline engines, a need has developed for fuels and fuel mixtures which reduce or eliminate deposits which accumulate on fuel injectors, intake valves, and combustion chamber surfaces. To reduce the amount of deposits formed in the fuel intake valves and fuel injectors and to reduce existing engine deposits, detergent additives designed for this purpose have been added to gasolines. While these detergents provide a significant reduction in the deposits which heretofore have inhibited the operation of fuel injected gasoline engines, such formulations may not provide the most desirable detergent effect for inhibiting and/or cleaning deposits on other internal engine parts, e.g., intake valves and combustion chambers. There is a need therefore for detergents which not only keep fuel injectors and fuel intake valves clean, but which effectively control deposits on other engine parts of internal combustion engines.

THE INVENTION

It has now been discovered that certain Mannich reaction products in combination with certain polyols with or without the use of particular polyolefinic compounds, provide exceptional reduction in engine deposits in addition to controlling octane requirement increase (ORI). Not all Mannich reaction products, polyols and/or polyolefinic compounds, and combinations thereof, however, have been found to provide the exceptional results and improvements in engine operation achieved by the formulations of this invention. Accordingly, this invention relates to a novel fuel additive composition which provides reduced fuel injector, intake valve and combustion chamber deposits while not adversely affecting the ORI of the engine. The composition comprises a) a Mannich reaction product of (i) a high molecular weight alkyl-substituted phenol, (ii) amine, and (iii) aldehyde wherein (i), (ii) and (iii) are reacted in a ratio within the range of from 1.0:0.1–10:0.1–10;

b) a polyoxyalkylene compound; and c) optionally, poly-α-olefin.

In general, the preferred additive compositions of this invention contain from about 50 to about 90 wt. % of (a), from about 10 to about 50 wt. % of (b), and from about 0 to about 40 wt. % of (c); more preferably from about 55 to about 80 wt. % of (a), from about 20 to about 40 wt. % of (b), and from about 0 to about 30 wt. % of (c); and most preferably from about 65 to about 75 wt. % of (a), from about 25 to about 35 wt. % of (b), and from about 0 to about 20 wt. % of (c).

In another embodiment, this invention provides a method for reducing engine deposits in gasoline engines while at the same time controlling the ORI of the engine. The method comprises fueling said engines with a fuel compositions comprising (a) a major amount of hydrocarbonaceous fuel in the gasoline boiling range and (b) a minor amount of fuel additive composition containing (A) a Mannich reaction product of (i) a high molecular weight alkyl-substituted phenol wherein the alkyl group has a number average molecular weight (Mn) of from about 600 to about 3000, (ii) amine, and (iii) aldehyde wherein (i) to (ii) to (iii) are reacted in a ratio within the range of from 1.0:0.1–10:0.1–10; (B) a polyoxyalkylene compound; and (C) optionally, poly-α-olefin, wherein the fuel additive composition contains from about 50 to about 90 wt. % of (A), from about 10 to about 50 wt. % of (B), and from about 0 to about 40 wt. % of (C).

It is to be understood that the Mannich reaction product component of this invention contains a significant portion of inactive ingredients. Subsequent to the manufacture of the Mannich reaction product, solvent is typically added to dilute the product. Solvent is generally present in the product in a minor amount, e.g., less than 20 wt. % of the recovered reaction product composition. Typically, however, the solvent is present in the diluted reaction product in an amount ranging from about 45 to about 55 wt. %. Accordingly, of the 50 to 90 wt. % of Mannich reaction product in the compositions and methods of this invention, only about 25 to about 45 wt. % of the reaction product is an active ingredient, the balance being solvent. A generally used solvent is a mixture of o-, p-, and m-xylene, mesitylene, and higher boiling aromatics such as Aromatic 150 (commercially available from Chemtech).

The Mannich reaction products of this invention are obtained by condensing an alkyl-substituted hydroxyaromatic compound whose alkyl-substituent has a number average molecular weight of from about 600 to about 14,000 (Mn), preferably polyalkylphenol whose polyalkyl substituent is derived from 1-mono-olefin polymers having a number average molecular weight of from about 600 to about 3000, more preferably from about 750 to about. 1200; an amine containing at least one >NH group, preferably an alkylene polyamine of the formula $$H_2N—(A—NH—)_xH$$

wherein A is a divalent alkylene radical having 1 to 10 carbon atoms and x is an integer from 1 to 10; and an aldehyde, preferably formaldehyde in the presence of a solvent.

High molecular weight Mannich reaction products useful as additives in the fuel additive compositions of this invention are preferably prepared according to conventional methods employed for the preparation of Mannich condensation products, using the above-named reactants in the respective molar ratios of high molecular weight alkyl-substituted hydroxyaromatic compound, amine, and aldehyde of approximately 1.0:0.1–10:1–10. A suitable condensation procedure involves adding at a temperature of from room temperature to about 95° C., the formaldehyde reagent (e.g., Formalin) to a mixture of amine and alkyl-substituted hydroxyaromatic compounds alone or in an easily removed organic solvent, such as benzene, xylene, or toluene or in solvent-refined neutral oil and then heating the reaction mixture at an elevated temperature (120°–175° C.) while preferably blowing with an inert stripping gas, such as nitrogen, carbon dioxide, etc. until dehydration is complete. The reaction product so obtained is finished by filtration and dilution with solvent as desired.

Preferred Mannich reaction product additives employed in this invention are derived from high molecular weight Mannich condensation products, formed by reacting an alkylphenol, an ethylene polyamine, and a formaldehyde affording reactants in the respective molar ratio of 1.0:0.5–2.0:1.0–3.0, wherein the alkyl group of the alkylphenol has a number average molecular weight (Mn) of from about 600 to about 3,000.

Representative of the high molecular weight alkyl-substituted hydroxyaromatic compounds are polypropylphenol, polybutylphenol and other polyalkylphenols with polypropylphenol being the most preferred. Polyalkylphenols may be obtained by the alkylation, in the presence of an alkylating catalyst such as $BF_3$, of phenol with high molecular weight polypropylene, polybutylene and other polyalkylene compounds to give alkyl substituents on the benzene ring of phenol having a number average molecular weight (Mn) of from about 600 to about 14,000.

The alkyl substituents on the hydroxyaromatic compounds may be derived from high molecular weight polypropylenes, polybutenes, and other polymers of mono-olefins, principally 1-mono-olefins. Also useful are copolymers of mono-olefins with monomers copolymerizable therewith wherein the copolymer molecule contains at least 90% by weight, of mono-olefin units. Specific examples are copolymers of butenes (butene-1, butene-2, and isobutylene) with monomers copolymerizable therewith wherein the copolymer molecule contains at least 90% by weight of propylene and butene units, respectively. Said monomers copolymerizable with propylene or said butenes include monomers containing a small proportion of unreactive polar groups such as chloro, bromo, keto, ether, aldehyde, which do appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene and the like. From the foregoing limitation placed on the monomer copolymerized with propylene or said butenes, it is clear that said polymers and copolymers of propylene and said butenes are substantially aliphatic hydrocarbon polymers. Thus, the resulting alkylated phenols contain substantially alkyl hydrocarbon substituents having a number average molecular weight (Mn) of from about 600 to about 14,000.

In addition to the foregoing high molecular weight hydroxyaromatic compounds, other phenolic compounds which may be used include, high molecular weight alkyl-substituted derivatives of resorcinol, hydroquinone, cresol, catechol, xylenol, hydroxy-di-phenyl, benzylphenol, phenethylphenol, naphthol, tolylnaphthol, among others. Preferred for the preparation of such preferred Mannich condensation products are the polyalkylphenol reactants, e.g., polypropylphenol and polybutylphenol whose alkyl group has a number average molecular weight of 600–3000, the more preferred alkyl groups having a number average molecular weight of 740–1200, while the most preferred alkyl groups is a polypropyl group having a number average molecular weight of 800–950, desirably about 900.

The preferred configuration of the alkyl-substituted hydroxyaromatic compound is that of a para-substituted mono-alkylphenol. However, any alkylphenol readily reactive in the Mannich condensation reaction may be employed. Accordingly, ortho mono-alkylphenols and dialkylphenols are suitable for use in this invention.

Representative amine reactants are alkylene polyamines, principally polyethylene polyamines. Other representative organic compounds containing at least one HN< group suitable for use in the preparation of the Mannich reaction products are well known and include the mono and di-amino alkanes and their substituted analogs, e.g., ethylamine, dimethylamine, dimethylaminopropyl amine, and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

The alkylene polyamine reactants which are useful with this invention include polyamines which are linear, branched, or cyclic; or a mixture of linear, branched and/or cyclic polyamines wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule such as ethylenediamine, diethylene triamine, triethylene tetramine, tetraethylene pentamine, pentaethylene hexamine, hexaethylene heptamine, heptaethylene octamine, octaethylene nonamine, nonaethylene decamine, and mixtures of such amines. Corresponding propylene polyamines such as propylene diamine, and dipropylene triamine, tripropylene tetramine, tetrapropylene pentamine, pentapropylene hexamine are also suitable reactants. A particularly preferred polyamine is a polyamine or mixture of polyamines having from about 3 to 7 nitrogen atoms with diethylene triamine or a combination or mixture of ethylene polyamines whose physical and chemical properties approximate that of diethylene triamine being the most preferred. In selecting an appropriate polyamine, consideration should be given to the compatibility of the resulting detergent/dispersant with the gasoline fuel mixture with which it is mixed.

Ordinarily the most highly preferred polyamine, diethylene triamine, will comprise a commercially available mixture having the general overall physical and/or chemical composition approximating that of diethylene triamine but which can contain minor amounts of branched-chain and cyclic species as well as some linear polyethylene polyamines such as triethylene tetramine and tetraethylene pentamine. For best results, such mixtures should contain at least 50% and preferably at least 70% by weight of the linear polyethylene polyamines enriched in diethylene triamine.

The alkylene polyamines are usually obtained by the reaction of ammonia and dihalo alkanes, such as dichloro alkanes. Thus, the alkylene polyamines are obtained from the reaction of 2 to 11 moles of ammonia with 1 to 10 moles of dichloro alkanes having 2 to 6 carbon atoms and the chlorines on different carbons.

Representative aldehydes for use in the preparation of high molecular weight products of this invention include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

Important considerations insofar as the present invention is concerned, are to insure that the alkylphenol having an akyl substituent with the desired number average molecular weight be reacted with the preferred polyethylene polyamine and aldehyde compounds and that the reactants be employed in proportions such that the resultant Mannich reaction product contains the requisite proportions of the chemically combined reactants, all as specified herein. When utilizing this combination of features, gasoline formulations containing the Mannich reaction products of this invention may be formed which possess exceptional effectiveness in controlling or reducing the amount of induction system deposits formed during engine operation and which permit adequate demulsification performance.

In addition to the Mannich reaction products, the compositions and methods of this invention utilize at least one particular polyol and/or at least one poly-α-olefin compound in an amount sufficient to reduce engine deposits and control octane requirement increase.

A key feature of this invention, therefore, is the use of a certain polyol compound as a component in fuel additive compositions. The polyol compounds which may be used can be represented by the following formula $$R_1—(R_2—O)_n—R_3$$

wherein $R_1$ is hydrogen, or hydroxy, alkyl, cycloalkyl, aryl, alkyaryl, aralkyl, alkoxy, cycloalkoxy, amine or amino group having 1–200 carbon atoms, $R_2$ is an alkylene group having 2–10 carbon atoms, and $R_3$ is hydrogen or alkyl, cycloalkyl, aryl, alkyaryl, aralkyl, alkoxy, cycloalkoxy, amine or amino group having 1–200 carbon atoms, and n is an integer from 1 to 500 representing the number of repeating alkoxy groups. Preferred polyol compounds are polyoxyalkylene glycol compounds and mono-ether derivatives thereof comprised of repeating units formed by reacting an alcohol with an alkylene oxide. The most preferred polyoxyakylene glycol derivative compound useful in the compositions and methods of this invention is known commercially as EMKAROX AF22 available from ICI Chemicals & Polymers Ltd. This compound has a pour point of about −42° C., a density of about 0.980 g/ml at 20° C., an open cup flash point of about 230° C., a viscosity of about 90 cSt at 40° C. and about 17 cSt at 100° C., and a viscosity index of about 200, and a volatility as determined by the method described herein of less than about 50%. The number average molecular weight of the polyoxyalkylene compounds of this invention is preferably in the range of from about 200 to about 5000, more preferably from about 500 to about 3,000, and most preferably from about 1,000 to about 2,000.

The polyoxyalkylene compounds of this invention may be prepared by condensation of the corresponding oxides, or oxide mixtures, such as ethylene or 1,2-propylene oxides as set forth more fully in U.S. Pat. Nos. 2,425,755; 2,425,845; 2,448,664; and 2,457,139 incorporated herein by reference as if fully set forth.

An optional component of the fuel compositions of this invention is poly-α-olefin. The poly-α-olefins (PAO) useful in compositions and methods of this invention are preferably the unhydrotreated poly-α-olefins. As used herein, poly-α-olefins are unhydrogenated or unhydrotreated oligomers, primarily trimers, tetramers and pentamers of alphaolefin monomers containing from 6 to 12, generally 8 to 12 and most preferably about 10 carbon atoms. Their synthesis is outlined in Hydrocarbon Processing. Feb. 1982, page 75 et seq. and essentially comprises catalytic oligomerization of short chain linear alpha olefins (suitably obtained by catalytic treatment of ethylene). The nature of an individual PAO depends in part on the carbon chain length of the original alphaolefin, and also on the structure of the oligomer. The exact molecular structure may vary to some extent according to the precise conditions of the oligomerization, which is reflected in changes in the physical properties of the final PAO. Since the suitability of a particular PAO is determined primarily by its physical properties, and in particular its viscosity, the various products are generally differentiated and defined by their viscosity characteristics. According to the present invention, polyalphaolefins having a viscosity (measured at 100° C.) from 2 to 20 centistokes are particularly desirable for forming fuel additive compositions of this invention. Preferably, the polyalphaolefin has a viscosity of at least 8 centistokes, and most preferably about 10 centistokes at 100° C. The volatility of the poly-α-olefin is also a key feature of this invention and may be determined by the ensuing procedure.

To determine the volatility of the poly-α-olefin suitable for use with this invention, the following procedure is used. Poly-α-olefin (110–135 grams) is placed in a three-neck, 250 mL round-bottomed flask having a threaded port for a thermometer. Such a flask is available from Ace Glass (Catalog No. 6954-72 with 20/40 fittings). Through the center nozzle of the flask is inserted a stirrer rod having a Teflon blade, 19 mm wide×60 mm long (Ace Glass catalog No. 8085-07). The poly-α-olefin is heated in an oil bath to 300° C. for 1 hour while stirring the oil in the flask at a rate of 150 rpm. During the heating and stirring, the free space above the oil in the flask is swept with 7.5 L/hr of inert gas (eg. nitrogen, argon, etc.). The volatility of the poly-α-olefin thus determined is expressed in terms of the weight percent of material lost based on the total initial weight of material tested. Utilizing the foregoing procedure, it is particularly preferred to select poly-α-olefins for use in the additive formulations of this invention that have a volatility of less than about 50%, more preferably less than about 25%.

While not required for the purposes of this invention, it is preferred that the fuel compositions of this invention include other conventional additives such as antioxidants, demulsifiers, corrosion inhibitors, aromatic solvents, etc. Accordingly, components for use in the formulations of this invention will now be described.

Antioxidant. Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominantly or entirely of either (1) a hindered phenol antioxidant such as 2-tert-butylphenol, 2,6-di-tert-butylphenol, 2,4,6-tri-tert-butylphenol, 4-methyl-2,6-di-tert-butylphenol, 4,4'-methylenebis-(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are tertiary butyl phenols, such as 2,6-di-tert-butylphenol, 2,4,6-tri-tert-butylphenol, o-tertbutylphenol.

Demulsifier. A wide variety of demulsifiers are available for use in the practice of this invention, including, for example, polyoxyalkylene glycols, oxyalkylated phenolic resins, and like materials. Particularly preferred are mixtures of, polyoxyalkylene glycols and oxyalkylated alkylphenolic resins, such as are available commercially from Petrolite Corporation under the TOLAD trademark. One such proprietary product, identified as TOLAD 9308, is understood to be a mixture of these components dissolved in a solvent composed of heavy aromatic naphtha and isopropanol. This product has been found efficacious for use in the compositions of this invention. However, other known demulsifiers can be used such as TOLAD 286.

Corrosion Inhibitor. Here again, a variety of materials are available for use as corrosion inhibitors in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the aminosuccinic acids or derivatives thereof represented by the formula:

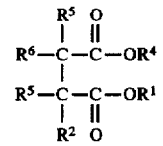

wherein each of $R^2$, $R^3$, $R^5$ and $R^6$ is, independently, a hydrogen atom or a hydrocarbyl group containing 1 to 30 carbon atoms, and wherein each of $R^1$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, and $R^6$ when in the form of hydrocarbyl groups, can be, for example, alkyl, cycloalkyl or aromatic containing groups. Preferably $R^1$, $R^2$, $R^3$, $R^4$ and $R^5$ are hydrogen or the same or different straight-chain or branched-chain hydrocarbon radicals containing 1–20 carbon atoms. Most preferably, $R^1$, $R^2$, $R^3$, $R^4$, and $R^5$ are hydrogen atoms. $R^6$ when in the form of a hydrocarbyl group is preferably a straight-chain or branched-chain saturated hydrocarbon radical.

Most preferred is a tetralkenyl succinic acid of the above formula wherein $R^1$, $R^2$, $R^3$, $R^4$ and $R^5$ are hydrogen and $R^6$ is a tetrapropenyl group.

Aromatic Hydrocarbon Solvent A wide variety of aromatic hydrocarbon solvents can be used with this invention such as benzene, and alkyl substituted benzene or mixtures thereof. Particularly useful are mixtures of o-, p-, and m-xylenes and mesitylene and higher boiling aromatics such as Aromatic 150 which is available from Chemtech. However, other mixtures of aromatic hydrocarbon solvents may also be used.

The relative proportions of the various ingredients used in the additive concentrates and fuels of this invention can be varied within reasonable limits. However, for best results, these compositions should contain from about 55 to about 80 parts by weight (preferably from about 65 to about 75 parts by weight) of Mannich reaction product; up to about 50 parts by weight (preferably from about 20 to about 40 parts by weight) of polyol; up to about 40 parts by weight (preferably from about 0 to about 30 parts by weight) of unhydrotreated poly-α-olefin; 0 to 5 parts by weight (preferably, from 1 to 3 parts by weight) of antioxidant; from 0 to 10 parts by weight (preferably, from 0.1 to 3 parts by weight) of demulsifier; from 0 to 75 parts by weight (preferably 5 to 25 parts by weight) of aromatic hydrocarbon solvent; and from 0 to 5 parts by weight (preferably, from 0.025 to 1.0 parts by weight) of corrosion inhibitor per each one hundred parts by weight of fuel additive composition.

The above additive compositions of this invention are preferably employed in hydrocarbon mixtures in the gasoline boiling range or hydrocarbon/oxygenate mixtures, or oxygenates, but are also suitable for use in middle distillate fuels, notably, diesel fuels and fuels for gas turbine engines. The nature of such fuels is so well known to those skilled in the art as to require no further comment. By oxygenates is meant alkanols and ethers such as methanol, ethanol, propanol, methyl-tert-butyl ether, ethyl-tert-butyl ether, tert-amyl-methyl ether and the like, or combinations thereof. It will of course be understood that the base fuels may contain other commonly used ingredients such as cold starting aids, dyes, metal deactivators, lubricity additives, octane improvers, cetane improvers, emission control additives, antioxidants, metallic combustion improvers, and the like.

When formulating the fuel compositions of this invention, the additives are employed in amounts sufficient to reduce or inhibit deposit formation on intake valves, fuel injectors, and cylinder chambers. Generally speaking, the fuel additive comprising a Mannich reaction product, a polyol, and optionally, an unhydrotreated polyalphaolefin will be employed in unleaded gasoline in minor amounts such that the gasoline portion of the fuel is the major component. By minor amount is meant less than about 3000 parts per million parts of gasoline, preferably, less than about 1500 parts per million parts of gasoline. A particularly preferred amount of additive is in the range of from about 600 to about 1200 parts per million parts of gasoline. The other components which are preferably used in conjunction with the fuel additive composition can be blended into the fuel individually or in various sub-combinations. However, it is definitely preferable to blend all of the components concurrently using an additive concentrate of this invention as this takes advantage of the mutual compatibility afforded by the combination of ingredients when in the form of an additive concentrate.

In order to illustrate the advantages of this invention, the following examples are given. In the first Example, a General Motors Quad 4 engine was used and the base fuel was an unadditized regular unleaded gasoline. The test runs illustrated in Examples 2, 3, and 4 were performed on stationary 2.3 L, 4 cylinder Ford engines as indicated. The fuel detergent used in these examples was the reaction product of (i) a 900 number average molecular weight polypropyl-substituted phenol, (ii) formalin, and (iii) diethylene triamine (commercially available from Ethyl Corporation as HiTEC® 4997. When used, the poly-α-olefin was a 10 cSt unhydrotreated poly-α-olefin of 1-decene (hereinafter referred to as PAO). Where an antioxidant was used in the fuel additive compositions, the antioxidant was HiTEC® 4733 (commercially available from Ethyl Corporation). HiTEC® 4733 is a mixture of tert-butyl phenols containing about 10 wt. % 2-tert-butyl phenol, about 75 wt. % 2,6-di-tert-butyl phenol, about 2 wt. % 2,4-di-tert-butyl phenol, and about 13 wt. % 2,4,6-tri-tert-butyl phenol.

EXAMPLE 1

For each run, a 1991, General Motors 2.3 L QUAD 4 engine was operated for 5,000 miles and the amount of deposits were determined. The engine was operated on a driving cycle representative of 10% city, 20% suburban and 70% highway driving. Average speed was 45.7 miles per hour with the engine accumulating more than 900 miles per day. Before each test was begun, the intake manifold and cylinder head were cleaned and inspected, the fuel injectors were checked for proper flow and spray pattern. Following each cleaning and inspection, the engine was rebuilt with new intake valves and the crankcase oil was changed. The crankcase oil used in the test runs was an SAE 5W-30 SG API-quality oil. Table 1 gives the compositions of additives in the fuel for each run as well as the average of the intake valve (IVD) and combustion chamber deposits (CCD) for each cylinder. The combustion chamber deposits are a combination of the piston top deposits and the cylinder head deposits. Runs 1 and 2 give base line results for the unadditized fuel, and fuel containing Mannich detergent and PAO only. Runs 3–8 are of the invention and illustrate the reduction in deposits achieved by additive formulations containing Mannich detergent/dispersant and a polyoxyalkylene compound.

TABLE 1

| Run No. | HiTEC ® 4997 (ptb) | HiTEC ® 4733 (ptb) | AF-22 (ptb) | P-1200* (ptb) | PAO (ptb) | Average deposits (mg) |
|---|---|---|---|---|---|---|
| 1 | — | — | — | — | — | 905 |
| 2 | 80 | 4 | — | — | 40 | 877 |
| 3 | 80 | — | — | 40 | — | 962 |
| 4 | 80 | 4 | — | 40 | — | 736 |
| 5 | 80 | — | — | 20 | 20 | 864 |
| 6 | 80 | 4 | 40 | — | — | 846 |
| 7 | 80 | — | 20 | — | 20 | 805 |
| 8 | 80 | — | 40 | — | — | 746 |

*P-1200 - Polyether polyol having a number average molecular weight of about 1200 (Available commercially from Dow Chemical Company).

EXAMPLE 2

In the next series of runs, a 1985, Ford 2.3L, 4 cylinder, single spark plug engine was run for 200 hours under various loads utilizing Union Oil fuel and containing the additives indicated in Table 2. The transient test cycle consisted of 2 minutes at 1,400 rpm and under a load of 18 inches of Hg intake manifold vacuum, 5 minutes at 2,000 rpm and a load of 12 inches of Hg intake manifold vacuum, and 3 minutes at 2,500 rpm at 10 inches Hg intake manifold vacuum. The engine coolant temperature was maintained at about 74° C. and the combustion air was controlled at a temperature of 32° C. and a humidity of 80 grains of moisture per pound of dry air. The octane requirement increase is the difference in octane requirement as measured at 0 and 200 hours. The crankcase oil used in the test runs was an SAE 5W-30 SG API-quality oil. New intake valves and valve stem seals were installed after each test run, and new exhaust valves were installed every fourth test run. Prior to and subsequent to each test run, the intake valves, ports, manifolds, and throttle blade were weighed and/or rated. Runs 10, 11, and 12, are given for comparative purposes and represent the baseline case of fuel without additive. Runs 10, 11, 12, and 13 were run with a different lot of the same fuel as runs 14, 15, 16, and 17. Results of the tests indicate a significant reduction in intake valve deposits (IVD) with surprisingly little change in ORI or combustion chamber deposits.

TABLE 2

| Run No. | HiTEC ® 4997 (ptb) | Anti-oxidant (ptb) | AF-22 (ptb) | PAO (ptb) | IVD (mg) | CCD (mg) | ORI |
|---|---|---|---|---|---|---|---|
| 10 | — | — | — | — | 721.0 | 1587 | 10 |
| 11 | — | — | — | — | 519.8 | 1668 | 8 |
| 12 | — | — | — | — | 577 | 1855 | 8–10 |
| 13 | 90 | — | 45 | — | 28.3 | 2210 | 11 |
| 14 | 90 | — | 45 | — | 43.1 | 1481 | 10 |
| 15 | 90 | — | 22.5 | 22.5 | 41.6 | 1655 | 11 |
| 16 | 90 | 4* | 45 | — | 37.8 | 1745 | 11 |
| 17 | 90 | 4** | 45 | — | 28.0 | 1740 | 9 |

*AN-69 - sulfurized di-butyl phenol
**NPS - nonylphenyl sulfide

EXAMPLE 3

This series of runs is similar to the runs of Example 2. In this series of runs, a 1985, 2.3L, 4 cylinder Ford engine containing a single spark plug was run for 112 hours, operating between a 3-minute "power" cycle (37 HP) at 2,800 rpm and a 1-minute "idle" cycle (0–4 HP) at 2,000 rpm. The engine coolant temperature was maintained at about 74° C. and the combustion air was not temperature and humidity controlled. The octane requirement increase is the difference in octane requirement as measured at 0 and 112 hours. The crankcase oil used in the test runs was an SAE 10W-40 SG API-quality oil. New intake valves and valve stem seals were installed after each test run, and new exhaust valves were installed every fourth test run. Prior to and subsequent to each test run, the intake valves, ports, manifolds, and throttle blade were weighed and/or rated. Table 3 illustrates the advantages of fuel additives of this invention.

TABLE 3

| Run No. | HiTEC ® 4997 (ptb) | Anti-oxidant (ptb) | AF-22 (ptb) | PAO (ptb) | IVD (mg) | CCD (mg) | ORI |
|---|---|---|---|---|---|---|---|
| 18 | 90 | — | 45 | — | 19.8 | 1348 | 7 |
| 19 | 90 | — | 45 | — | 14.1 | 1469 | 8 |
| 20 | 90 | — | 22.5 | 22.5 | 22.5 | 1282 | 10 |
| 21 | 90 | 4* | 45 | — | 29.6 | 1273 | 8 |
| 22 | 90 | 4** | 45 | — | 24.9 | 1193 | 10 |

*AN-69 - sulfurized di-butyl phenol
**NPS - nonylphenyl sulfide

EXAMPLE 4

The final series of runs is similar to the runs of Example 3. In this series of runs, a 1993, dual spark plug, 4 cylinder 2.3 L Ford engine was run for 100 hours, operating between a 3-minute "power" cycle at 2,800 rpm and a 1-minute "idle" cycle at 2,000 rpm. The combustion air was controlled at a temperature of 32° C. and a humidity of 80 grains of moisture per pound of dry air. Runs 23–27 were run at an engine coolant temperature of 91° C. and Runs 28 and 29 were run at an engine coolant temperature of 74° C. The octane requirement increase is the difference in octane requirement as measured at 0 and 100 hours. The crankcase oil used in the test runs was an SAE 5W-30 SG API-quality oil. Prior to and subsequent to each test run, the intake valves, ports, manifolds, and throttle blade were weighed and/or rated. New spark plugs, intake valves and valve guide seals were installed every test run. New exhaust valves were installed every fourth test run. Table 4 illustrates the advantages of fuel additives of this invention.

TABLE 4

| Run No. | HiTEC ® 4997 (ptb) | Anti-oxidant (ptb) | AF-22 (ptb) | PAO (ptb) | IVD (mg) | CCD (mg) | ORI |
|---|---|---|---|---|---|---|---|
| 23 | — | — | — | — | 261.0 | 647 | 6 |
| 24 | 90 | — | 45 | — | 41.6 | 961 | 5 |
| 25 | 90 | — | 22.5 | 22.5 | 29.5 | 1283 | 5 |
| 26 | 90 | 4* | 45 | — | 31.2 | 1183 | 6 |
| 27 | 90 | 4* | 22.5 | 22.5 | 37.3 | 1258 | 6 |
| 28 | — | — | — | — | 338.0 | 719 | 8 |
| 29 | 90 | — | 45 | — | 29.5 | 1283 | 5 |

*AN-69 - sulfurized di-butyl phenol

Variations in the invention as set forth in the foregoing description and examples are considered to be within the spirit and scope of the appended claims.

What is claimed is:

1. A fuel additive composition for control of intake valve deposits formed by mixing together at least the following ingredients:

(a) a Mannich reaction product formed from (i) a high molecular weight alkyl-substituted phenol wherein the alkyl group has a number average molecular weight (Mn) of from about 600 to about 3000, (ii) amine, and (iii) aldehyde in a molar ratio of (i), (ii) and (iii) within the range of from 1.0:0.1–10:0.1–10, respectively;

(b) a polyoxyalkylene glycol monoether compound formed by reacting an alcohol with 1,2-propylene oxide and having a number average molecular weight in the range of from about 500 to about 3000; and (c) optionally, poly-α-olefin in proportions of from about 50 to about 90 wt. % of (a), from about 10 to about 50 wt. % of (b), and from 0 to about 40 wt. % of (c).

2. The fuel additive composition of claim 1 wherein the alkyl group has a number average molecular weight within the range of from about 800 to about 950.

3. The fuel additive composition of claim 1 wherein said proportions are from about 50 to about 90 wt. % of (a), from about 10 to about 50 wt. % of (b), and none of (c).

4. The fuel additive composition of claim 3 wherein the number average molecular weight of (b) is in the range of from about 1,000 to about 2,000.

5. The fuel additive composition of claim 4 wherein the alkyl group has a number average molecular weight within the range of from about 800 to about 950, and wherein (b) is a polyoxyalkylene glycol monoether formed by reacting an alcohol with an alkylene oxide.

6. The fuel additive composition of claim 5 wherein the alkylene oxide is 1,2-propylene oxide.

7. The fuel additive composition of claim 5 wherein said molar ratio of (i), (ii) and (iii) is within the range of from 1.0:0.5–2.0:1.0–3.0, respectively.

8. A fuel composition comprising a gasoline fuel with which has been blended in an amount sufficient to reduce or inhibit deposit formation on intake valves, the fuel additive composition in accordance with claim 1.

9. A fuel composition comprising a gasoline fuel with which has been blended in an amount sufficient to reduce or inhibit deposit formation on intake valves, the fuel additive composition in accordance with claim 3.

10. A fuel composition comprising a gasoline fuel with which has been blended in an amount sufficient to reduce or inhibit deposit formation on intake valves, the fuel additive composition in accordance with claim 4.

11. A fuel composition comprising a gasoline fuel with which has been blended in an amount sufficient to reduce or inhibit deposit formation on intake valves, the fuel additive composition in accordance with claim 5.

12. A fuel composition comprising a gasoline fuel with which has been blended in an mount sufficient to reduce or inhibit deposit formation on intake valves, the fuel additive composition in accordance with claim 6.

13. A fuel composition comprising a gasoline fuel with which has been blended in an mount sufficient to reduce or inhibit deposit formation on intake valves, the fuel additive composition in accordance with claim 7.

14. A method for controlling intake valve deposits in a gasoline engine comprising fueling and operating said engine with a gasoline fuel composition with which has been blended in an mount sufficient to reduce or inhibit deposit formation on intake valves, the fuel additive composition in accordance with claim 1.

15. The method of claim 14 wherein the alkyl group of the reaction product has a number average molecular weight within the range of from about 800 to about 950.

16. A method for controlling intake valve deposits in a gasoline engine comprising fueling and operating said engine with a gasoline fuel composition with which has been blended in an mount sufficient to reduce or inhibit deposit formation on intake valves, the fuel additive composition in accordance with claim 3.

17. A method for controlling intake valve deposits in a gasoline engine comprising fueling and operating said engine with a gasoline fuel composition with which has been blended in an amount sufficient to reduce or inhibit deposit formation on intake valves, the fuel additive composition in accordance with claim 4.

18. A method for controlling intake valve deposits in a gasoline engine comprising fueling and operating said engine with a gasoline fuel composition with which has been blended in an amount sufficient to reduce or inhibit deposit formation on intake valves, the fuel additive composition in accordance with claim 5.

19. A method for controlling intake valve deposits in a gasoline engine comprising fueling and operating said engine with a gasoline fuel composition with which has been blended in an amount sufficient to reduce or inhibit deposit formation on intake valves, the fuel additive composition in accordance with claim 6.

20. A method for controlling intake valve deposits in a gasoline engine comprising fueling and operating said engine with a gasoline fuel composition with which has been blended in an amount sufficient to reduce or inhibit deposit formation on intake valves, the fuel additive composition in accordance with claim 7.

21. A fuel composition comprising a gasoline fuel with which has been blended in an amount sufficient to reduce or inhibit deposit formation on intake valves:

(a) a Mannich reaction product formed from (i) a high molecular weight alkyl-substituted phenol wherein the alkyl group has a number average molecular weight (Mn) of from about 600 to about 3000, (ii) amine, and (iii) aldehyde in a molar ratio of (i), (ii) and (iii) within the range of from 1.0:0.5–2.0:1.0–3.0, respectively;

(b) a polyoxyalkylene compound having a number average molecular weight in the range of from about 1000 to about 2,000, said polyoxyalkylene compound being a polyoxyalkylene glycol monoether formed by reacting an alcohol with 1,2-propylene oxide; and (c) optionally, poly-α-olefin in proportions of from about 50 to about 90 wt. % of (a), from about 10 to about 50 wt. % of (b), and from 0 to about 40 wt. % of (c).

22. A fuel composition comprising a gasoline fuel with which has been blended in an amount sufficient to reduce or inhibit deposit formation on intake valves, a composition formed by mixing together at least the following ingredients:

(a) a Mannich reaction product formed from (i) a high molecular weight alkyl-substituted phenol wherein the alkyl group has a number average molecular weight (Mn) of from about 600 to about 3000; (ii) amine, and (iii) aldehyde in a molar ratio of (i), (ii) and (iii) within the range of from 1.0:0.1–10:0.1–10, respectively; and (b) a polyoxyalkylene glycol monoether compound formed by reacting an alcohol with 1,2-propylene oxide and having a number average molecular weight in the range of from about 500 to about 3000; and in proportions of from about 50 to about 90 wt. % of (a) and from about 10 to about 50 wt. % of (b).

23. The fuel composition of claim 22 wherein said proportions are from about 65 to about 75 wt. % of (a) and from about 25 to 35 wt. % of (b).

24. The fuel composition of claim 22 wherein the number average molecular weight of (b) is in the range of from about 1,000 to about 2,000.

25. The fuel composition of claim 24 wherein said proportions are from about 65 to about 75 wt. % of (a) and from about 25 to 35 wt. % of (b).

26. A method of controlling intake valve deposits in a gasoline engine comprising fueling and operating said engine with a gasoline fuel composition in accordance with claim 22.

27. A method of controlling intake valve deposits in a gasoline engine comprising fueling and operating said engine with a gasoline fuel composition in accordance with claim 23.

28. A method of controlling intake valve deposits in a gasoline engine comprising fueling and operating said engine with a gasoline fuel composition in accordance with claim 24.

29. A method of controlling intake valve deposits in a gasoline engine comprising fueling and operating said engine with a gasoline fuel composition in accordance with claim 25.

30. A fuel additive composition formed by mixing together at least the following ingredients:

(a) a Mannich reaction product formed from (i) a high molecular weight alkyl-substituted phenol wherein the alkyl group has a number average molecular weight (Mn) of from about 600 to about 3000; (ii) amine, and (iii) aldehyde in a molar ratio of (i), (ii) and (iii) within the range of from 1.0:0.1–10:0.1–10, respectively; and (b) a polyoxyalkylene glycol monoether compound formed by reacting an alcohol with 1,2-propylene oxide and having a number average molecular weight in the range of from about 500 to about 3000; and in proportions of from about 50 to about 90 wt. % of (a) and from about 10 to about 50 wt. % of (b).

31. The fuel additive composition of claim 30 wherein said proportions are from about 65 to about 75 wt. % of (a) and from about 25 to 35 wt. % of (b).

32. The fuel additive composition of claim 30 wherein the number average molecular weight of (b) is in the range of from about 1,000 to about 2,000.

33. The fuel additive composition of claim 32 wherein said proportions are from about 65 to about 75 wt. % of (a) and from about 25 to 35 wt. % of (b).

* * * * *